United States Patent [19]

Fisher

[11] 3,952,755

[45] Apr. 27, 1976

[54] HAIR DRESSING APPARATUS AND METHOD

[76] Inventor: Karol C. Fisher, Penthouse East, 183-11 Hillside Ave., Queens, N.Y. 11432

[22] Filed: Dec. 26, 1974

[21] Appl. No.: 536,609

[52] U.S. Cl. ..... 132/161; 132/11 R

[51] Int. Cl.[2] ..... A45D 24/00

[58] Field of Search ..... 132/112, 9, 139, 144, 132/124–125, 128, 101, 144, 161

[56] References Cited

UNITED STATES PATENTS

| | | | |
|---|---|---|---|
| 752,288 | 2/1904 | Gordon | 132/101 |
| 2,139,709 | 12/1938 | Yaw | 132/161 |
| 3,390,689 | 7/1968 | Newman | 132/9 |

*Primary Examiner*—G. E. McNeill

[57] ABSTRACT

A method for uniformly dividing the hair on a person's head so that uniform treatment may be given to representative tufts from various portions of the hair utilizes a comb and a large needle. A comb is preferably employed provided with teeth of different root depths and of different widths thereby forming a natural separation of the tufts of hair as the comb is drawn through the head. A needle is used to complete the separation.

1 Claim, 5 Drawing Figures

HAIR DRESSING APPARATUS AND METHOD

The aforementioned Abstract is not intended to define the invention of the application which, of course, is measured by the claims, nor is it intended to be limiting as to the scope of the invention in any way.

FIELD OF THE INVENTION

This invention relates to an apparatus and method for treating hair and in particular to a method and apparatus for uniformly subdividing the hair.

BACKGROUND OF THE INVENTION

In the treatment of human hair, particularly in coloring the head of hair it is desirable to treat various tufts taken uniformly across the body of hair at the same time so that a uniform distribution of color is obtained. Accordingly, it is an object of this invention to provide a method for uniformly treating hair of the human being.

A further object of this invention is to provide an improved apparatus for subdividing the hair on the head of a person in an uniform manner.

Still further objects and advantages of the present invention will become obvious or will be pointed out with particularity as the following description proceeds, taken in conjunction with the accompanying drawing.

BRIEF DESCRIPTION OF THE PREFERRED EMBODIMENTS

Figure 1:
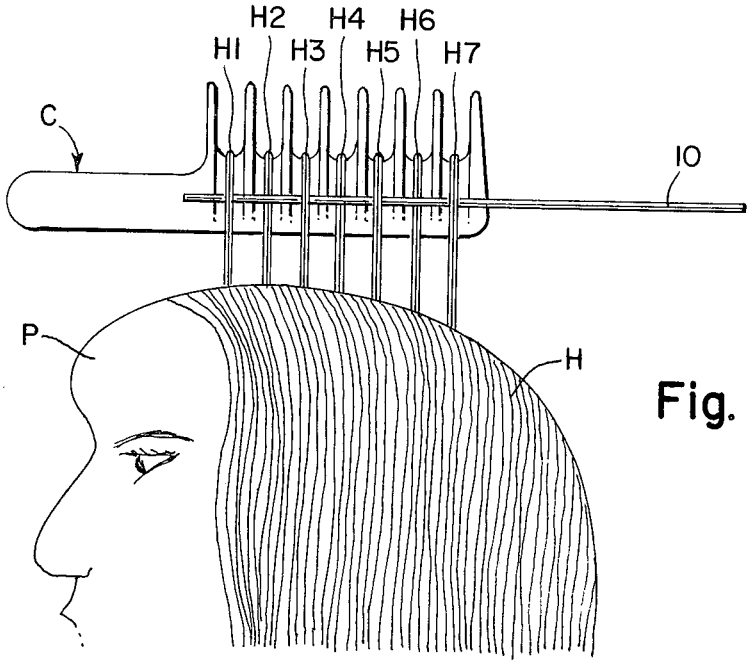
FIG. 1 is a side view of a portion of the human head with a comb being drawn through the hair.

Referring now to FIG. 1 there is shown a comb C drawn through the hair H of a person P. A needle 10 comprising a wire about 0.05 inch in diameter or the tail of a tail comb is shown threaded through alternate tufts of hair H1, H3, H5, etc.

Figure 2:
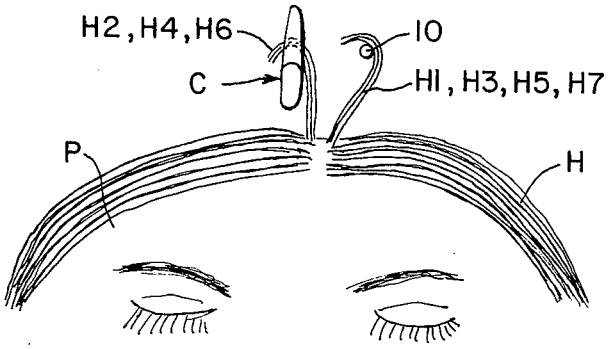
FIG. 2 is a side view of the head shown in FIG. 1 after a separation of hair has occurred.

In FIG. 2 there is shown the comb C and the needle 10 in the act of lifting away the tufts of hair H1, H3, H5, etc. The group of hairs H2, H4, H6, etc. left in the comb and those carried by the wire may now be separately treated.

One application of the device is, for example, where the colorist desires to treat the groups of hair in the comb with one shade of blond and the other group carried by the needle 10 with still a different shade of blond, in order to get a more interesting and natural looking dispersion of color.

Figure 3:
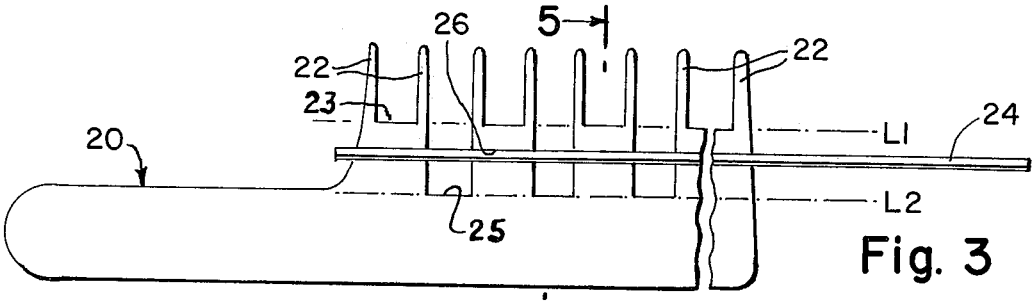
FIG. 3 is a side elevational view of a comb having incorporated therein the features of this invention.
Figure 4:
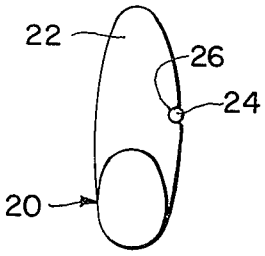
FIG. 4 is a side elevational view of the comb shown in FIG. 3.
Figure 5:
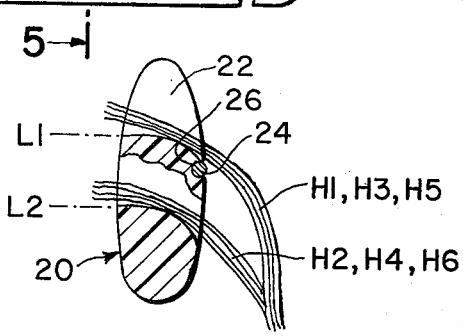
FIG. 5 is a section taken along lines 5—5 of FIG. 3.

To facilitate the threading operation and to save the time of the operator it is preferred to employ the comb shown in FIGS. 3–5. Here the comb 20 is provided with teeth 22 wherein the roots 23, 25 or the depth of the teeth between adjacent teeth varies from level L1 to L2. The result of this can be seen in FIG. 5 wherein groups of hair H1, H3, H5, etc. and groups of hair H2, H4, H6, etc. are separated since they are resting on the roots between respective teeth. This provides room for the needle 24 which may be inserted in the cavity 26. A suitable material for the needle is a steel wire about 0.05 inch in diameter.

While shown as a separation of the hair in two equal groups, it should be understood that by providing roots at three different levels a separation of the hair into three different groups can be just as easily obtained.

There has been disclosed heretofore the best embodiments of the invention presently contemplated. However, it is to be understood that various changes and modifications may be made thereto without departing from the spirit of the invention.

What I claim as new and desire to secure by Letters Patent is:

1. In a comb of the class described having teeth arranged in pairs, with shallow roots between some of the pairs and deep roots between the teeth of the other pairs, said roots connecting the inner portions of the teeth, the improvement comprising:

a recess extending longitudinally along a side face between the tops of the shallow roots and the tops of the deep roots and a removeable wire member adapted to fit into the recess.

* * * * *